US009449544B2

(12) United States Patent
Duan et al.

(10) Patent No.: US 9,449,544 B2
(45) Date of Patent: Sep. 20, 2016

(54) AMOLED PIXEL CIRCUIT AND DRIVING METHOD

(71) Applicant: BOE TECHNOLOGY GROUP CO., LTD., Beijing (CN)

(72) Inventors: Liye Duan, Beijing (CN); Lirong Wang, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 358 days.

(21) Appl. No.: 14/349,860

(22) PCT Filed: Aug. 13, 2013

(86) PCT No.: PCT/CN2013/081344

§ 371 (c)(1),
(2) Date: Apr. 4, 2014

(87) PCT Pub. No.: WO2014/190620

PCT Pub. Date: Dec. 4, 2014

(65) Prior Publication Data

US 2016/0240127 A1 Aug. 18, 2016

(30) Foreign Application Priority Data

May 31, 2013 (CN) ..... 2013 1 0214664

(51) Int. Cl.

| | |
|---|---|
| ***G09G 5/10*** | (2006.01) |
| ***G09G 3/20*** | (2006.01) |
| ***G09G 3/32*** | (2016.01) |

(52) U.S. Cl.

CPC ..... *G09G 3/2007* (2013.01); *G09G 3/3241* (2013.01); *G09G 2300/0819* (2013.01); *G09G 2310/0251* (2013.01); *G09G 2320/0271* (2013.01)

(58) Field of Classification Search

CPC ..... A01B 12/006; G09G 3/2007; G09G 3/3241; G09G 2300/0819; G09G 2310/0251; G09G 2320/0271

See application file for complete search history.

(56) References Cited

U.S. PATENT DOCUMENTS

2007/0040769 A1* 2/2007 Tai ..... G09G 3/3233 345/76

FOREIGN PATENT DOCUMENTS

CN 102346999 A 2/2012
CN 203250517 U 10/2013

OTHER PUBLICATIONS

Written Opinion of the International Searching Authority dated Feb. 18, 2014; PCT/CN2013/081344.

(Continued)

*Primary Examiner* — Charles Hicks
(74) *Attorney, Agent, or Firm* — Ladas & Parry LLP

(57) ABSTRACT

An AMOLED pixel circuit and driving method are disclosed. The AMOLED pixel circuit comprises a first transistor (T1), a second transistor (T2), a third transistor (T3), a fourth transistor (T4), a fifth transistor (T5), a sixth transistor (T6), a seventh transistor (T7), an eighth transistor (T8), a first capacitor (C1), a second capacitor (C2), a current source and a light-emitting device (OLED). The AMOLED pixel circuit can perform a rapid charging in a low gray scale state; different currents may be provided according to information on a high or low gray scale, and thus the AMOLED pixel circuit may be applied widely; an output current during a light-emitting period is a normal operational current of the light-emitting device; therefore not only a charging process is expedited, but also a normal operation of the light-emitting device is ensured.

15 Claims, 4 Drawing Sheets

(56) References Cited

OTHER PUBLICATIONS

International Search Report mailed Feb. 27, 2014; PCT/CN2013/083144.

First Chinese Office Action dated Nov. 27, 2014; Appln. No. 201310214664.3.

* cited by examiner

AMOLED PIXEL CIRCUIT AND DRIVING METHOD

TECHNICAL FIELD

The present disclosure relates to a field of display technique, and particularly to an AMOLED pixel circuit and driving method.

BACKGROUND

An Active Matrix Organic Light Emitting Diode (AMOLED) drives an Organic Light Emitting Diode (OLED) to emit light by using Thin Film Transistors (TFTs).

A driving manner of an OLED pixel circuit may be classified as a current-driving manner and a voltage-driving manner, and in a voltage-driving circuit, a current $I_{OLED}$ flowing through the OLED may be calculated with an Equation as follows:

$$I_{OLED} = \frac{1}{2}\mu_n \cdot Cox \cdot \frac{W}{L} \cdot (V_{data} - V_{OLED} - V_{th})^2$$

herein, $\mu_n$ is a mobility of carriers, Cox is a capacitance in an oxide layer at a gate, $$\frac{W}{L}$$

is a width-length ratio of the transistor, $V_{data}$ is a data voltage, $V_{OLED}$ is an operational voltage of the OLED and is shared by all pixel units, $V_{th}$ is a threshold voltage of the transistor, which is a positive value for an enhanced TFT and is a negative value for a depletion TFT.

It can be seen from the above equation that the current would be different if the $V_{th}$ is different among the different pixel units. If the $V_{th}$ of a pixel drifts as time elapses, the currents before and after drifting would be different and the image sticking may occur. Also, the differences in the current may also be caused by differences in the operational voltages of the OLEDs due to non-uniformity in the OLED devices.

The current-driving mode is advantageous over the voltage-driving mode in that, the current $I_{OLED}=I_{data}$, and a current-driving circuit would have a function for adjusting a level of the present current by itself if the threshold voltage of the pixel drifts as time elapses, which is independent of the $V_{th}$ of TFTs, and a display which is uniform spatially and is stable temporally would be realized. However, the current-driving circuit is generally applied to a screen with a small size because of its long driving time.

FIG. 1 is a diagram illustrating a circuit structure of the existing current-driving manner. An operation of this circuit is divided into two periods: a pre-charging period and a light-emitting period. In the first period, a power supply ARVDD of the pixel circuit is at a low level, a transistor T4 is turned off, a scan signal SCAN is at a high level, transistors T1 and T2 are turned on, and a capacitor Cs is charged; in the second period, the power supply ARVDD of the pixel circuit is at the high level, the scan signal SCAN is at the low level, the transistors T1 and T2 are turned off, and an OLED emits light. Such a current-driving pixel circuit has a defect of over-long charging time, which thus limits the application scope of the current-driving pixel circuit.

SUMMARY

Embodiments of the present disclosure provide an AMOLED pixel circuit and a driving method therefore in order to settle a problem that the existing AMOLED pixel circuit performs a charging slowly.

Technique Solution

Considering the defects in the prior art, the embodiments of the present disclosure provide an AMOLED pixel circuit comprising a first transistor, a second transistor, a third transistor, a fourth transistor, a fifth transistor, a sixth transistor, a seventh transistor, an eighth transistor, a first capacitor, a second capacitor, a current source and a light-emitting device; a gate of the first transistor is connected with a gate of the eighth transistor, a gate of the fifth transistor and a charging signal scan control unit, respectively; a drain of the first transistor is connected with a drain of the second transistor, a drain of the third transistor, a first terminal of the second capacitor and a power supply, respectively; a source of the first transistor is connected with a gate of the third transistor and a first terminal of the first capacitor, respectively; a gate of the eighth transistor is connected with a drain of the eighth transistor; a source of the eighth transistor is connected with a second terminal of the second capacitor, a gate of the second transistor and a drain of the sixth transistor, respectively; a gate of the third transistor is connected with a gate of the fourth transistor; a source of the third transistor is connected with a second terminal of the first capacitor, a drain of the fifth transistor and a source of the fourth transistor, respectively; a source of the second transistor is connected with a drain of the fourth transistor; a source of the fourth transistor is connected with a drain of the seventh transistor; a gate of the seventh transistor is connected with a trigger signal control unit; a source of the seventh transistor is connected with a positive electrode of the light-emitting device; a negative electrode of the light-emitting device is grounded; a gate of the sixth transistor is connected with a discharging signal scan control unit; a source of the fifth transistor is connected with a source of the sixth transistor and a first terminal of the current source, respectively; and a second terminal of the current source is grounded.

According to an embodiment, the charging signal scan control unit comprises a first scan line for controlling the first capacitor and the second capacitor to be charged; the discharging signal scan control unit comprises a second scan line for controlling the second capacitor to be discharged; the trigger signal control unit comprises a light-emitting control line for controlling the light-emitting device to emit light.

According to an embodiment, a ratio between a width-length ratio of the third transistor and a width-length ratio of the fourth transistor is a preset value.

According to an embodiment, the current source is a semi-digital constant-current source capable of recognizing high and low gray scale states.

According to an embodiment, the semi-digital constant-current source provides an extracting current to discharge the second capacitor in a low gray scale state; and provides an injecting current to charge the second capacitor in a high gray scale state.

According to an embodiment, the light-emitting device is an organic electroluminescent diode device.

A driving method for the above AMOLED pixel circuit, comprising:

charging the first capacitor and the second capacitor;

discharging the second capacitor; and controlling the light-emitting device to emit light.

According to an embodiment, charging the first capacitor and the second capacitor further comprises:

outputting a high potential by the charging signal scan control unit;

turning on the first transistor, the second transistor, the third transistor, the fourth transistor, the fifth transistor and the eighth transistor; and turning off the sixth transistor and the seventh transistor.

According to an embodiment, discharging the second capacitor further comprises:

outputting a high potential by the discharging signal scan control unit;

turning on the second transistor, the third transistor, the fourth transistor and the sixth transistor; and turning off the first transistor, the fifth transistor, the seventh transistor and the eighth transistor.

According to an embodiment, controlling the light-emitting device to emit light further comprises:

outputting a high potential by the trigger signal control unit;

turning on the second transistor, the third transistor, the fourth transistor and the seventh transistor; and turning off the first transistor, the fifth transistor, the sixth transistor and the eighth transistor.

Beneficial Effect

According to the embodiments of the present disclosure, the semi-digital constant-current source may provide different currents according to the information on a high or low gray scale and may be applied widely. By selecting the width-length ratio of the third transistor T3 and that of the fourth transistor T4, the ratio between the width-length ratio of the third transistor and the width-length ratio of the fourth transistor is set to a preset value, so that the AMOLED pixel circuit may be controlled to perform a rapid charging in the low gray scale state; after the completion of the rapid charging, the light-emitting device is provided with a normal operational current by controlling the corresponding transistors to be turned off through the semi-digital constant-current source. Thus, not only a charging process is expedited, but also a normal operation of the light-emitting device is ensured.

DETAILED DESCRIPTION

Implementations of the present disclosure will be described in details in connection with the drawings and embodiments. Following embodiments are only intended to illustrate the present disclosure, instead of limiting a scope of the present disclosure.

In order to address the issue of slow charging in the existing AMOLED pixel circuit, the embodiments of the present disclosure provide an AMOLED pixel circuit and a driving method.

Figure 1:
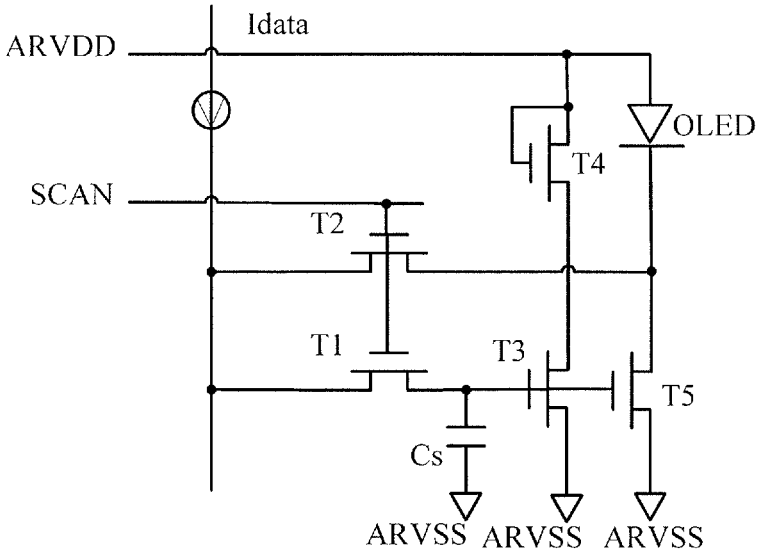
FIG. 1 is a diagram illustrating a circuit structure of an existing current-driving manner.
Figure 2:
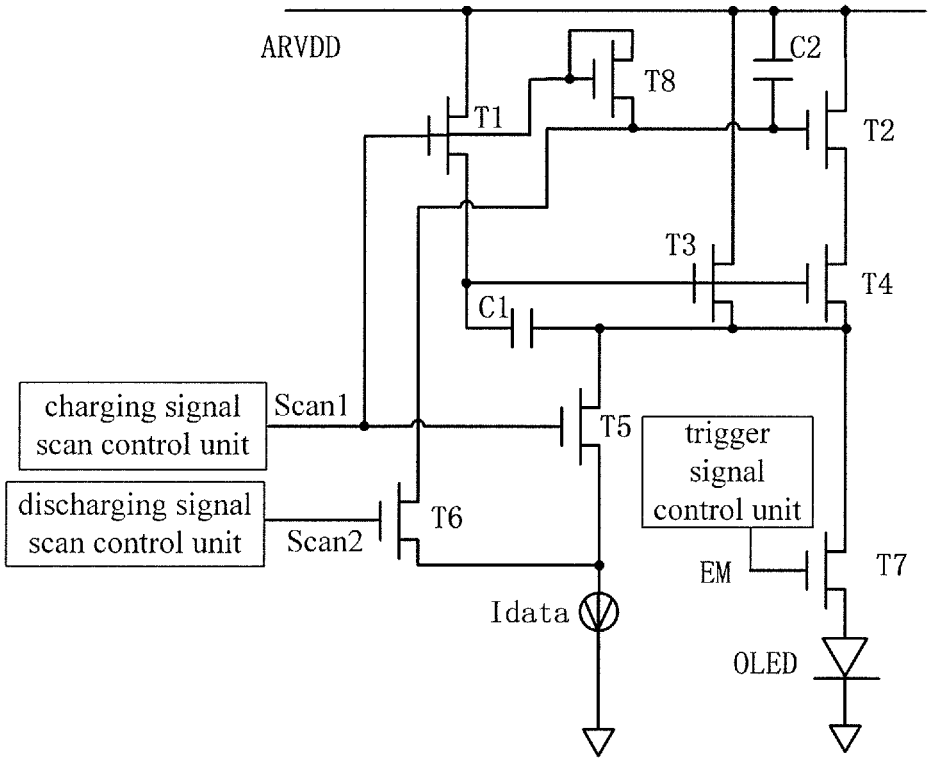
FIG. 2 is an AMOLED pixel circuit according to the present disclosure.

The AMOLED pixel circuit according to the embodiments of the present disclosure is as illustrated in FIG. 2, and comprises a first transistor, a second transistor, a third transistor, a fourth transistor, a fifth transistor, a sixth transistor, a seventh transistor, an eighth transistor, a first capacitor, a second capacitor, a current source and a light-emitting device; a gate of the first transistor is connected with a gate of the eighth transistor, a gate of the fifth transistor and a charging signal scan control unit, respectively; a drain of the first transistor is connected with a drain of the second transistor, a drain of the third transistor, a first terminal of the second capacitor and a power supply, respectively; a source of the first transistor is connected with a gate of the third transistor and a first terminal of the first capacitor, respectively; a gate of the eighth transistor is connected with a drain of the eighth transistor; a source of the eighth transistor is connected with a second terminal of the second capacitor, a gate of the second transistor and a drain of the sixth transistor, respectively; a gate of the third transistor is connected with a gate of the fourth transistor; a source of the third transistor is connected with a second terminal of the first capacitor, a drain of the fifth transistor and a source of the fourth transistor, respectively; a source of the second transistor is connected with a drain of the fourth transistor; a source of the fourth transistor is connected with a drain of the seventh transistor; a gate of the seventh transistor is connected with a trigger signal control unit; a source of the seventh transistor is connected with a positive electrode of the light-emitting device; a negative electrode of the light-emitting device is grounded; a gate of the sixth transistor is connected with a discharging signal scan control unit; a source of the fifth transistor is connected with a source of the sixth transistor and a first terminal of the current source, respectively; and a second terminal of the current source is grounded.

In an example, the charging signal scan control unit comprises a first scan line for controlling the first capacitor and the second capacitor to be charged; the discharging signal scan control unit comprises a second scan line for controlling the second capacitor to be discharged; the trigger signal control unit comprises a light-emitting control line for controlling the light-emitting device to emit light.

In an example, a ratio between a width-length ratio of the third transistor and a width-length ratio of the fourth transistor is a preset value. The current source is a semi-digital constant-current source capable of recognizing a high and low gray scale states. The semi-digital constant-current source forms two digital currents, that is, an extracting current and an injecting current whose signs are opposite, by controlling signals based on an existing constant-current source, in order to recognize and distinguish a high gray scale and a low gray scale. The extracting current in the present embodiment is a negative value corresponding to a case in which the low gray scale is recognized, while the injecting current is a positive value corresponding to a case in which the high gray scale is recognized. The semi-digital constant-current source may provide different currents according to the information on the high or low gray scale and may be applied widely. The semi-digital constant-current source may further provide a typical analog current. The light-emitting device is an organic electroluminescent diode device OLED.

Figure 3:
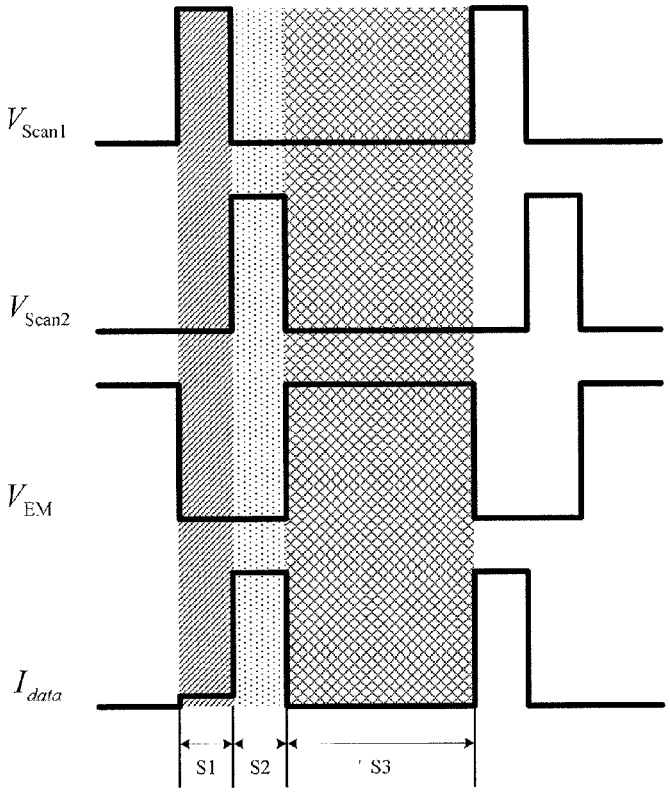
FIG. 3 is a timing chart of the AMOLED pixel circuit according to the present disclosure.

As illustrated in FIG. 2, the AMOLED pixel circuit according to the present disclosure comprises a first to eighth transistors T1~T8, and all of the transistors in the present disclosure are n-type transistors. The storage capacitors comprises a first capacitor C1 and a second capacitor C2. The first scan line Scan1, the second scan line Scan2 and the light-emitting control line EM supply control signals. The light-emitting device is an OLED. A power supply of the pixel circuit is ARVDD. $I_{data}$ is the current supplied from the semi-digital constant-current source capable of recognizing the high and low gray scale states and supplying different currents correspondingly. The $I_{data}$ is an output from a row driver "Source Driver" actually, which may provide different "programmable" charging currents according to the different high and low gray scales. In a case of high gray scale and a large current, the "programmable" charging current provided by it has an original value; while the "programmable" charging current provided by it has a value of (N+1) times of the original value in a case of low gray scale and a small current. FIG. 3 is the timing chart of the AMOLED pixel circuit according to the present disclosure. In this figure, $V_{Scan1}$ is a voltage on the first scan line Scan1, $V_{Scan2}$ is a voltage on the second scan line Scan2, and $V_{EM}$ is a voltage on the light-emitting control line EM. S1, S2 and S3 denote a first period, a second period and a third period, respectively.

In order that a large current is charged in the case of low gray scale, the ratio between the width-length ratio of the third transistor T3 and that of the fourth transistor T4 is 1:N, in which the value of N depends on requirements, for example, N=9.

The driving method according to the embodiments of the present disclosure comprises:

S1 period, wherein the first capacitor and the second capacitor are charged:

the charging signal scan control unit outputs a high potential; and the first transistor, the second transistor, the third transistor, the fourth transistor, the fifth transistor and the eighth transistor are turned on; and the sixth transistor and the seventh transistor are turned off.

This period is a pre-charging period for charging the first capacitor and the second capacitor.

Figure 4:
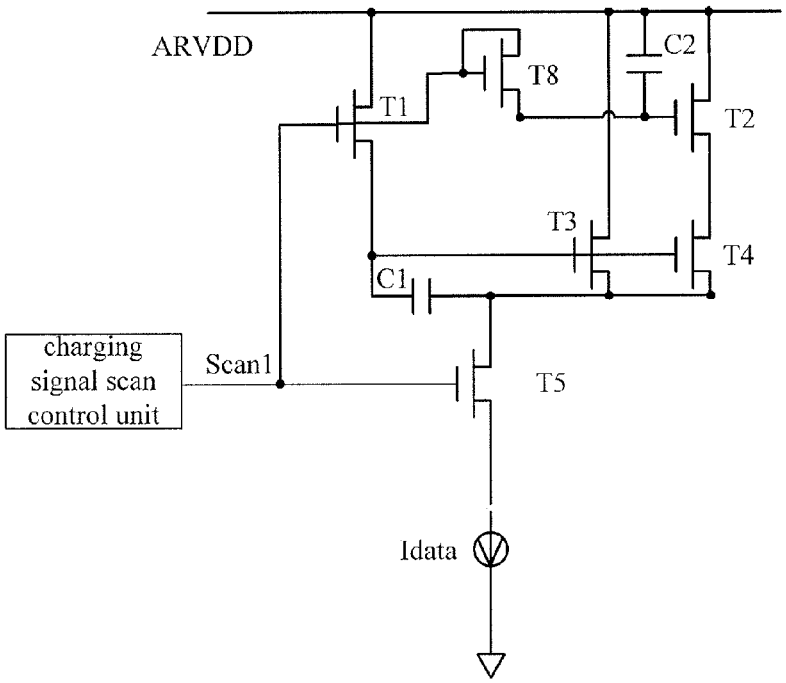
FIG. 4 is a circuit diagram illustrating a pre-charging period of the AMOLED pixel circuit according to the present disclosure.

As illustrated in FIG. 4, the first scan line Scan1 is at a high level, the second scan line Scan2 is at a low level, the light-emitting control line EM is at a low level, so that the transistors T1~T5 and T8 are turned on and the transistors are turned off. This process completes a process for charging the capacitors C1 and C2 (in the case of low gray scale, the actual light-emitting current only comprises a current from the T3, and a charging current is a sum of the currents from the third transistor T3 and the fourth transistor T4. If the width-length ratio of the fourth transistor T4 is N times of that of the third transistor T3, the charging current would be (N+1) times of a conventional charging current. As charging, the third transistor T3 and the fourth transistor T4 are both in a same operational state, which is similar to a "current mirror" in an analog circuit), and the OLED is in a dark state at this time since the EM is at a low level. The semi-digital constant-current source functions to provide an analog current in the S1 period, wherein a value of the analog current is correlated with a brightness value to displayed by the OLED, and a voltage signal corresponding to the analog current is stored in the capacitor C1.

In the S2 period, the second capacitor is discharged:

the discharging signal scan control unit outputs the high potential;

the second transistor, the third transistor, the fourth transistor and the sixth transistor are turned on; and the first transistor, the fifth transistor, the seventh transistor and the eighth transistor are turned off;

the light-emitting device is in the low gray scale state, and the discharging of the second capacitor is performed.

Figure 5:
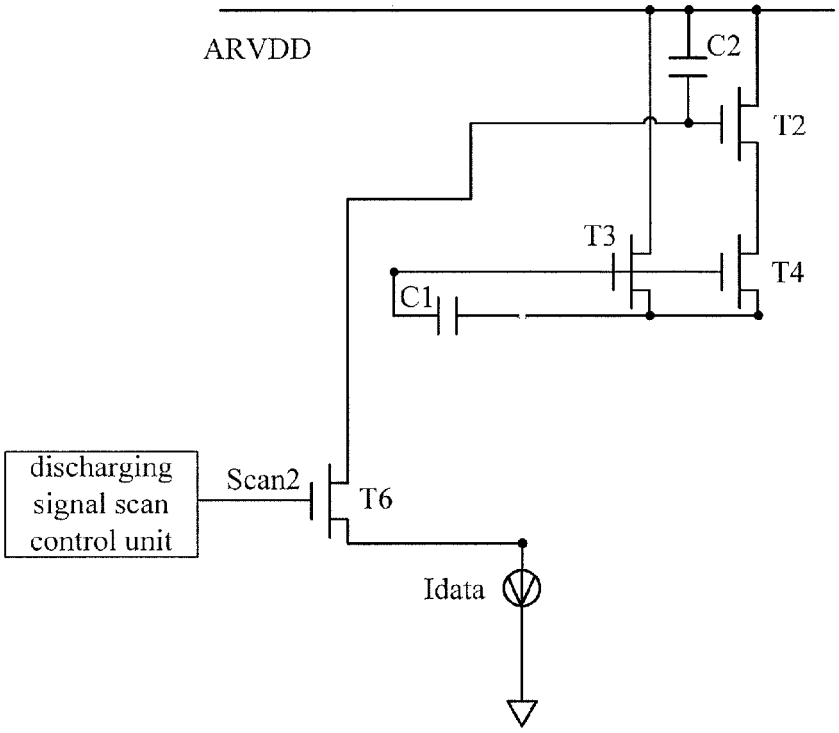
FIG. 5 is a circuit diagram illustrating a discharging period of the AMOLED pixel circuit according to the present disclosure.

This period is a period for discharging the second capacitor. As illustrated in FIG. 5, the first scan line Scan1 is at a low level, the second scan line Scan2 is at a high level, and the light-emitting control line EM is at a low level, so that the second to fourth transistors T2~T4 and the sixth transistor T6 are turned on and the remaining transistors are turned off. This process is the process for discharging the second capacitor C2 in the case of low gray scale state (during a light-emitting period after charging, the low gray scale may reduce a light-emitting current to a value required actually by turning off the second transistor T2 and the fourth transistor T4); and the second capacitor C2 is charged in the case of the high gray scale state. Because the light-emitting control line EM at the low level, the OLED is also in the dark state at this time. During the S2 period, the semi-digital constant-current source functions differently according to the low gray scale state and the high gray scale state: the semi-digital constant-current source may provide an extracting current (a positive digital current) to extract the charges in the second capacitor C2 (that is, the charges at the gate of the second transistor T2) in the low gray scale state; the semi-digital constant-current source may provide an injecting current (a negative digital current) to charge the second capacitor C2 in the high gray scale state.

In the S3 period: the light-emitting device is controlled to emit light:

the trigger signal control unit outputs the high potential;

the second transistor, the third transistor, the fourth transistor and the seventh transistor are turned on;

the first transistor, the fifth transistor, the sixth transistor and the eighth transistor are turned off; and the light-emitting device is in a light-emitting state.

Figure 6:
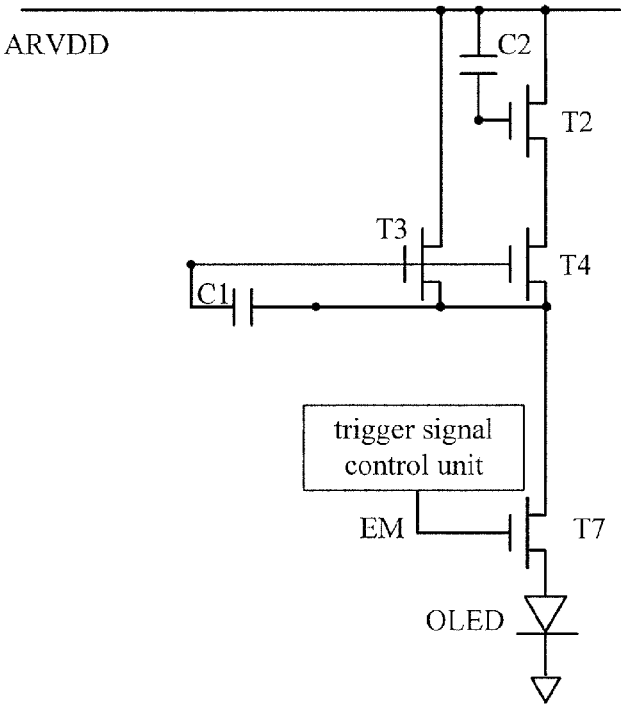
FIG. 6 is a circuit diagram illustrating a light-emitting period, in which a light-emitting device is controlled to emit light, of the AMOLED pixel circuit according to the present disclosure.

The period is a period for controlling the light-emitting device to emit light. As illustrated in FIG. 6, the first scan line Scan1 and the second scan line Scan2 are at a low level, the light-emitting control line EM is at a high level, so that the second to fourth transistors T2~T4 and the seventh transistor T7 are turned on and the remaining transistors are turned off. Because the EM is at a high level, the OLED emits light during this period. In the case of the low gray scale state, the charges in the second capacitor C2 are discharged completely in the second period, so that the second transistor T2 and the fourth transistor T4 are turned off, and the actual light-emitting current only comprises the current of T3; in the case of the high gray scale state, the capacitor C2 is charged in the second period, the second transistor T2 and the fourth transistor T4 are turned on, and the actual light-emitting current is a sum of the currents of the T3 and the T4.

It can be seen from the above three periods that, setting the ratio value between the width-length ratio of the third transistor T3 and that of the fourth transistor T4 as a preset proportion plays an important role in the pixel circuit, and the semi-digital constant-current source may recognize the high and low gray scale states in an image. In the case of low gray scale state, the second capacitor C2 is discharged and in turn the fourth transistor T4 is turned off in the second period, and the light-emitting current of the OLED only comprises the current of the third transistor T3 in the third period; while in the first period, a charging current for the capacitor C1 is the sum of the currents of the T3 and T4, therefore the charging current would be the (N+1) times of the current of T3 if the ratio value between the width-length ratio of the third transistor T3 and that of the fourth transistor T4 is N, so that the charging time of the current-driving manner is reduced and the problem of long charging time in the current-driving pixel circuit is settled.

The disclosure would be described by means of detailed embodiments below.

Figure 7:
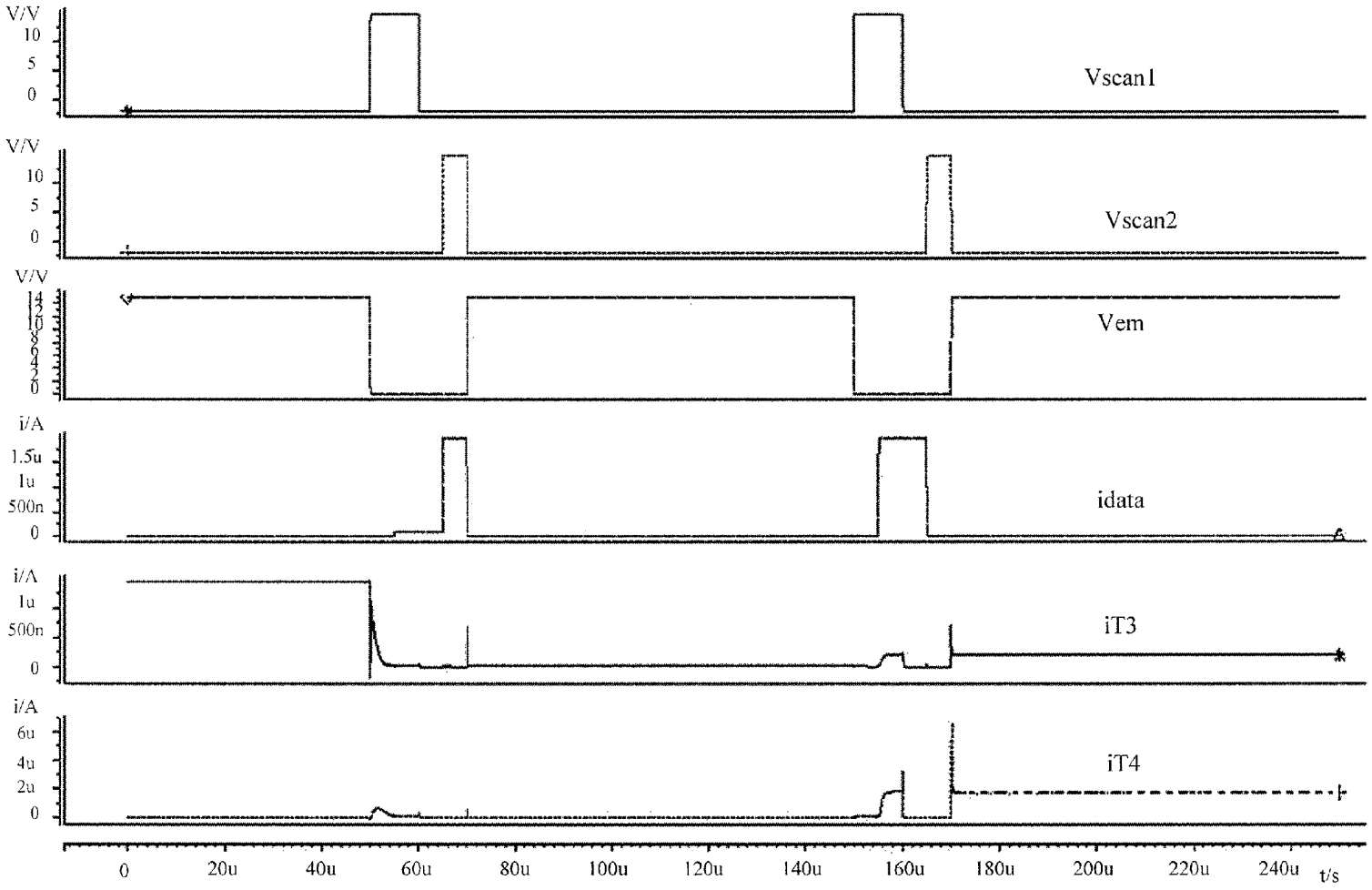
FIG. 7 is a simulation diagram of the embodiments of the present disclosure.

The simulation diagram shows two periods in which a single sub-pixel operates. A current of 10 nA is written into the pixel in the first period, while a current of 2 μA is written into the pixel in the second period. FIG. 7 shows a waveform diagram by simulating the pixel circuit with hspice software.

In FIG. 7, Vscan1 is a voltage waveform on the scan line Scan1, Vscan2 is a voltage waveform on the scan line Scan2, Vem is a voltage waveform on the light-emitting control line, idata is a current of the current source, iT3 is a current flowing through the third transistor T3, and iT4 is a current flowing through the fourth transistor T4.

In order to obtain an output current of 10 nA for the OLED, the simulation in the present embodiment selects the ratio value between the width-length ratio of the third transistor T3 and that of the fourth transistor T4 as 1:9. Therefore a current which is 10 times of 10 nA, namely the current of 100 nA, may be input. It can be seen that there are three operational periods of the pixel circuit from the waveform diagram. In the low gray scale state, the current of 10 nA flows through the third transistor T3, and a current of the fourth transistor T4 is approximately 0, so it may be determined that the fourth transistor T4 is turned off. In the second period, the third transistor T3 and the fourth transistor T4 operates simultaneously. A current of 2 μA is output to the OLED, and it can be seen from the figure that the sum of the currents of the third transistor T3 and the fourth transistor T4 is approximately 2 μA.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. An AMOLED pixel circuit comprising a first transistor, a second transistor, a third transistor, a fourth transistor, a fifth transistor, a sixth transistor, a seventh transistor, an eighth transistor, a first capacitor, a second capacitor, a current source and a light-emitting device;

a gate of the first transistor is connected with a gate of the eighth transistor, a gate of the fifth transistor and a charging signal scan control unit, respectively; a drain of the first transistor is connected with a drain of the second transistor, a drain of the third transistor, a first terminal of the second capacitor and a power supply, respectively; a source of the first transistor is connected with a gate of the third transistor and a first terminal of the first capacitor, respectively; a gate of the eighth transistor is connected with a drain of the eighth transistor; a source of the eighth transistor is connected with a second terminal of the second capacitor, a gate of the second transistor and a drain of the sixth transistor, respectively; a gate of the third transistor is connected with a gate of the fourth transistor; a source of the third transistor is connected with a second terminal of the first capacitor, a drain of the fifth transistor and a source of the fourth transistor, respectively; a source of the second transistor is connected with a drain of the fourth transistor; a source of the fourth transistor is connected with a drain of the seventh transistor; a gate of the seventh transistor is connected with a trigger signal control unit; a source of the seventh transistor is connected with a positive electrode of the light-emitting device; a negative electrode of the light-emitting device is grounded; a gate of the sixth transistor is connected with a discharging signal scan control unit; a source of the fifth transistor is connected with a source of the sixth transistor and a first terminal of the current source, respectively; and a second terminal of the current source is grounded.

2. The AMOLED pixel circuit of claim 1, wherein the charging signal scan control unit comprises a first scan line for controlling the first capacitor and the second capacitor to be charged; the discharging signal scan control unit comprises a second scan line for controlling the second capacitor to be discharged; the trigger signal control unit comprises a light-emitting control line for controlling the light-emitting device to emit light.

3. The AMOLED pixel circuit of claim 1, wherein a ratio between a width-length ratio of the third transistor and a width-length ratio of the fourth transistor is a preset value.

4. The AMOLED pixel circuit of claim 1, wherein the current source is a semi-digital constant-current source capable of recognizing high and low gray scale states.

5. The AMOLED pixel circuit of claim 4, wherein the semi-digital constant-current source provides an extracting current to discharge the second capacitor in a low gray scale state; and provides an injecting current to charge the second capacitor in a high gray scale state.

6. The AMOLED pixel circuit of claim 1, wherein the light-emitting device is an organic electroluminescent diode device.

7. A driving method for the AMOLED pixel circuit of claim 1, comprising:

charging the first capacitor and the second capacitor;

discharging the second capacitor; and controlling the light-emitting device to emit light.

8. The driving method of claim 7, wherein charging the first capacitor and the second capacitor further comprises:

outputting a high potential by the charging signal scan control unit;

turning on the first transistor, the second transistor, the third transistor, the fourth transistor, the fifth transistor and the eighth transistor; and turning off the sixth transistor and the seventh transistor.

9. The driving method of claim 8, wherein discharging the second capacitor further comprises:

outputting a high potential by the discharging signal scan control unit;

turning on the second transistor, the third transistor, the fourth transistor and the sixth transistor; and turning off the first transistor, the fifth transistor, the seventh transistor and the eighth transistor.

10. The driving method of claim 9, wherein controlling the light-emitting device to emit light further comprises:

outputting a high potential by the trigger signal control unit;

turning on the second transistor, the third transistor, the fourth transistor and the seventh transistor; and turning off the first transistor, the fifth transistor, the sixth transistor and the eighth transistor.

11. The driving method of claim 7, wherein the charging signal scan control unit comprises a first scan line for controlling the first capacitor and the second capacitor to be charged; the discharging signal scan control unit comprises a second scan line for controlling the second capacitor to be discharged; the trigger signal control unit comprises a light-emitting control line for controlling the light-emitting device to emit light.

12. The driving method of claim 7, wherein a ratio between a width-length ratio of the third transistor and a width-length ratio of the fourth transistor is a preset value.

13. The driving method of claim 7, wherein the current source is a semi-digital constant-current source capable of recognizing high and low gray scale states.

14. The driving method of claim 13, wherein the semi-digital constant-current source provides an extracting current to discharge the second capacitor in a low gray scale state; and provides an injecting current to charge the second capacitor in a high gray scale state.

15. The driving method of claim 7, wherein the light-emitting device is an organic electroluminescent diode device.

* * * * *